US006453768B2

(12) United States Patent
Wehner et al.

(10) Patent No.: US 6,453,768 B2
(45) Date of Patent: Sep. 24, 2002

(54) PEDAL

(75) Inventors: Andreas Wehner, Schmitten; Christian Weis, Mainz; Peter Kohlen, Neu-Anspach, all of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/780,562

(22) Filed: Feb. 9, 2001

(30) Foreign Application Priority Data

Feb. 19, 2000 (DE) ..... 100 07 743

(51) Int. Cl.[7] ..... G05G 1/14

(52) U.S. Cl. ..... 74/512; 74/513; 74/560; 267/275; 192/81 C

(58) Field of Search ..... 74/512–514, 560–562, 74/522, 478; 403/109.3, 377; 192/81 C; 464/57; 267/275, 214; 180/274, 275, 280

(56) References Cited

U.S. PATENT DOCUMENTS

| | | | | | |
|---|---|---|---|---|---|
| 5,233,882 | A | * | 8/1993 | Byram et al. | 74/514 |
| 5,261,512 | A | | 11/1993 | Young | |
| 5,335,563 | A | * | 8/1994 | Yamamoto et al. | 74/512 |
| 5,868,040 | A | * | 2/1999 | Papenhagene ta l. | 74/513 |
| 5,934,152 | A | * | 8/1999 | Hannewald | 74/512 |
| 5,937,707 | A | * | 8/1999 | Rixon et al. | 74/560 |
| 6,003,404 | A | * | 12/1999 | Hannewald | 74/512 |
| 6,109,133 | A | * | 8/2000 | Kohlen | 74/512 |
| 6,186,025 | B1 | * | 2/2001 | Engelgau et al. | 74/512 |
| 6,250,176 | B1 | * | 6/2001 | Reimann et al. | 74/512 |
| 6,311,578 | B1 | * | 11/2001 | Kohlen | 74/513 |
| 6,336,377 | B1 | * | 1/2002 | Reimann et al. | 74/512 |

FOREIGN PATENT DOCUMENTS

| | | | | |
|---|---|---|---|---|
| DE | 4300096 | 7/1994 | | |
| DE | 4426549 | 2/1996 | | |
| DE | 19517172 | 11/1996 | | |
| DE | 19536699 | 4/1997 | | |
| DE | 19720390 | 11/1998 | | |
| DE | 19811442 | 9/1999 | | |
| GB | 1436064 | 5/1976 | | |
| JP | 63-306957 | * 12/1988 | | 74/512 |
| JP | 3-284455 | * 12/1991 | | 74/512 |
| JP | 2001-260697 | * 9/2001 | | 74/512 |
| WO | 9730863 | 8/1997 | | |

* cited by examiner

*Primary Examiner*—Vinh T. Luong
(74) *Attorney, Agent, or Firm*—Martin A. Farber

(57) ABSTRACT

A pedal (2), in particular for a motor vehicle, has a pedal arm (6) which can be deflected at its first end region (8) by a force (4), in particular a foot force, is mounted at its second end region (10) in a manner such that it can pivot about a pivot spindle (18) mounted in a housing (16), and is acted upon in a manner such that it can be pivoted back into an initial position by a restoring spring element (20) which surrounds the pivot spindle (18). In this arrangement, the restoring spring element (20) is supported on a first lever arm (36) of a pivotably mounted lever (38). The second lever arm (44) of the lever (38) bears via a friction body (50) against a friction surface (56). The friction surface (56) in turn can be pivoted about the pivot spindle (18) of the pedal arm (6) and is arranged on the second end region (10) of the pedal arm (6). This pedal (2) has a particularly low outlay on production and at the same time the coefficient of friction of the friction pairing formed from the friction body (50) and the friction surface (56) is settable within a particularly large range of values. Wherein, the friction surface (56) is part of a friction element (55), and the second end region (10) of the pedal arm (6) is connected fixedly to the friction element (55) via an adhesive material (66).

12 Claims, 3 Drawing Sheets

PEDAL

FIELD AND BACKGROUND OF THE INVENTION

The invention relates to a pedal, in particular for a motor vehicle, having a pedal arm which can be deflected at its first end region by a force, in particular a foot force, is mounted at its second end region in a manner such that it can pivot about a pivot spindle mounted in a housing, and is acted upon in a manner such that it can be pivoted back into an initial position by a restoring spring element which surrounds the pivot spindle, the restoring spring element being supported on a first lever arm of a pivotably mounted lever whose second lever arm bears via a friction body against a friction surface which can be pivoted about the pivot spindle and is arranged on the second end region of the pedal arm.

Pedals of the abovementioned type are nowadays frequently used as gas pedals in motor vehicles for controlling the speed. In this case, during operation of the motor vehicle the driver of the motor vehicle deflects the pedal arm of the pedal by means of a foot force in order to reach a certain speed of the motor vehicle. In this arrangement, the deflection of the pedal arm is usually coupled mechanically or electronically to a control unit via which the speed of the motor vehicle can be set. The following generally applies: the greater the deflection of the pedal arm, the greater the speed of the motor vehicle.

During operation of the motor vehicle uneven road conditions may result in joltings of the vehicle movement and therefore in slight changes to the foot force applied to the pedal arm by the driver. These jottings of the vehicle movement may cause a change in the pedal position, which results in a change in the speed of the motor vehicle.

In order to prevent an unintentional change in the pedal position by the driver of the motor vehicle, the pedal arm of the pedal is supported on the first lever arm of the pivotably mounted lever by means of the restoring spring element surrounding the pivot spindle. When the pedal arm is deflected, the restoring spring element deflects the first lever arm of the lever and at the same time the second lever arm of the lever pivots in the direction of the second end region of the pedal. From a certain angle of deflection of the pedal arm onward there occurs contact between the friction body, which is arranged on the second lever arm, and the friction surface which is arranged on the second end region of the pedal arm. The frictional force acting between the friction body and the friction surface inhibits the foot force which deflects the pedal arm. In this arrangement, the spring action of the restoring spring element causes, with increasing deflection of the pedal arm, an increase in the frictional force between the friction body and the friction surface, and a self-starting vibration, the so called frictional vibration, occurs. The frictional vibration is caused by the difference between the relatively large frictional force when running on occurs, i.e. when there is contact between the friction body and the friction surface, and the relatively small frictional force during the subsequent sliding movement. The frictional vibration occurs in particular at very small sliding speeds and is a nuisance because it causes jerky sliding. This effect, which is also known as the "stick-slip effect", can be perceived clearly by the people in the interior of the vehicle as a squealing noise during operation of the pedal.

In order to suppress this squealing noise it is known, for example from DE 198 11 442 A1, to connect the friction body to the second lever arm of the pivotably mounted lever via a vibration damper. This causes the friction body to be decoupled mechanically from the second lever arm of the lever, as a result of which the friction body can vibrate freely relative to the second lever arm of the lever. The friction surface is usually formed integrally with the pedal arm and therefore cannot vibrate. The squealing noise is therefore reliably avoided by means of the friction damper additionally arranged on the second lever arm of the pivotably mounted lever. A disadvantage of this solution is the fact that the friction surface always consists of the material from which the pedal arm or at least the second end region of the pedal arm is also manufactured. This means that the design of the friction pairing formed by the friction body and the friction surface is determined only by a suitable selection of the friction body. This is because the contribution of the friction surface to the friction pairing is predetermined by the material of the pedal arm and is not a variable parameter of the friction pairing. In order to bring about a change in the friction pairing by the friction surface, the pedal arm would have to be manufactured from a different material than the previous material, which generally has a disadvantageous effect on the production costs and on the outlay on production of the pedal arm and is therefore not usual in practice.

SUMMARY OF THE INVENTION

The invention is therefore based on the object of specifying a pedal of the abovementioned type which requires a particularly low outlay on production and in which the coefficient of friction of the friction pairing formed from the friction body and the friction surface can be set within a particularly large range of values.

According to the invention, this object is achieved in that the friction surface is part of a friction element, and the second end region of the pedal arm is connected fixedly to the friction element via an adhesive material.

The invention proceeds from the consideration that a pedal which is to be produced in a particularly simple manner and is to be fitted in a particularly simple manner should have a particularly small number of elements which can be fitted together during the final installation of the pedal. However, both the material of the friction body and the material of the friction surface should be freely selectable so as to provide a particularly large range of values for the coefficient of friction of the friction pairing. This condition is met for the friction body, which can be fastened via the vibration damper to the second lever arm of the pivotably mounted lever during installation of the pedal. The material of the friction surface can be selected freely if the latter is not part of the second end region of the pedal arm. The friction surface is not part of the pedal arm if it is arranged separately on a friction element. The friction element which contains the friction surface can in turn—like the friction surface up to now—be arranged on the second end region of the pedal arm. However, a friction element designed in two pieces with the second end region of the pedal arm may be caused to vibrate and in an extreme case may become detached from the second end region of the pedal arm. These vibrations also cause noises. In order to avoid such malfunctions and noises of the pedal, the second end region of the pedal arm should be connected particularly firmly to the friction element without the outlay on production of the pedal being increased because of an additional element. For this purpose, the second end region of the pedal arm is connected fixedly to the friction element via an adhesive material. In this case, the adhesive material may be a glue, for example a commercially available glue, or else a firm synthetic material which undergoes a virtually nondetachable connection both with the second end region of the pedal arm and with the friction element.

The adhesive material is advantageously designed as a film which bonds on both sides. A self-adhesive film produces a homogeneous bonding surface and can be cut precisely into shape. In addition, before the friction element which contains the friction surface is fastened on the second end region of the pedal arm, a film can be fastened either on the underside of the friction element or on the second end region of the pedal arm, with the result that for the final installation the surfaces which are to be connected just need to be pressed on to one another. This means that the outlay required for installing the friction element containing the friction surface in or on the second end region of the pedal arm is particularly low.

The friction element which contains the friction surface is advantageously arranged in a form-fitting manner on or in the second end region of the pedal arm. By this means, the fitting of the friction surface on or in the second end region of the pedal arm proves to be particularly simple. Also, the friction surface is held on or in the second end region of the pedal arm by a form-fitting connection. This embodiment additionally secures the friction element on the second end region of the pedal arm and therefore constitutes a supplement to the firm bonding of the friction element on or in the second end region of the pedal arm.

The surface of the second end region of the pedal arm and the friction surface advantageously have different material properties. This enables the friction element, which contains the friction surface, and the second end region of the pedal arm to be produced from one material. By means of this refinement, the production of the friction element, which contains the friction surface, and of the second end region of the pedal arm is particularly cost effective, since then just one material has to be provided for production of the friction element and of the second end region of the pedal arm. Special treatment of the surface of the friction element, i.e. of the friction surface, then changes the material property thereof. If, for example, the second end region of the pedal arm and the friction element are manufactured from aluminum, the friction surface can be hardened by anodizing, as a result of which the surface of the friction element then has a different material property than the second end region of the pedal arm, which region is likewise manufactured from aluminum.

It is advantageous for the second end region of the pedal arm to be manufactured from a first material and for the friction surface to be manufactured from a second material which is different from the first material. It has proven particularly advantageous here if the second end region of the pedal arm is manufactured from a plastic and if the friction surface is manufactured from metal. This lightweight construction, which is associated with the plastic, of the second end region of the pedal arm brings about a particularly low weight for the second end region and therefore contributes to reducing the weight of the pedal. In addition, plastic can be adapted in a particularly simple manner to a very wide variety of geometrical forms, which makes it possible for special shape requests for the second end region of the pedal arm to be realized in a particularly simple manner. At the same time, the frictional strength of the friction surface is ensured by manufacturing the friction element, which contains the friction surface, from metal, in particular special steel.

The first lever arm of the lever advantageously has, on the side facing away from the pedal arm, an anti-wear stop which restricts the pivoting range of the lever and can act against a stop. The bearing of the anti-wear stop of the first lever arm of the lever against the stop prevents the second lever arm of the lever from becoming wedged by the second region of the pedal arm. By this means, even if the friction body becomes detached from the second lever arm of the lever, the functioning of the pedal is ensured in a particularly reliable manner, even if the inhibiting properties of the friction body are no longer effective if the friction body is detached. The stop may be arranged on the housing of the pivot spindle or may be part of the housing of the pivot spindle.

The second end region of the pedal arm advantageously has a guide in which the restoring spring element is arranged. The guide can be formed integrally with the second end region of the pedal arm or else can also be a guide body which can be arranged separately on the second end region of the pedal arm. A wear-induced change in shape of the restoring spring element is thereby avoided in a particularly reliable manner. Moreover, the design of the guide for the restoring spring element enables a predeterminable force of the restoring spring element to be set in a particularly simple manner.

The restoring spring element can advantageously act at its one end against an abutment formed on the first lever arm of the lever. The abutment predetermines the region at which this end of the restoring spring element can act against the lever. By defining the point of contact of the restoring spring element with the first lever arm of the lever, the force to be transmitted by the restoring spring element to the lever can be set particularly readily. The force transmitted by the restoring spring element to the first lever arm of the lever during deflection of the pedal arm presses the second lever arm of the lever by its friction body against the friction surface arranged on or in the second end region of the pedal arm. By this means, as the pedal arm is increasingly deflected, the friction between the friction body arranged on the second lever arm of the lever and the friction surface arranged on the second end region of the pedal arm increases, as the result of which, with increasing deflection of the pedal arm, more force is required for the deflection thereof. At the same time, the restoring spring element stretches and, when the force deflecting the pedal arm eases off, causes the pedal arm to be restored to the starting position.

The end of the restoring spring element, which can act against the abutment arranged on the first lever arm of the lever, additionally advantageously bears against a supporting body determining the direction of the force of the restoring spring element. If there were no supporting body, this end of the restoring spring element could initially become bent in the direction of the guide during deflection of the pedal arm and could only pivot the first lever arm of the lever from a certain angle of deflection of the pedal arm onward. In contrast, the supporting body guides the force of the restoring spring element directly to the abutment, so that even at very small angles of deflection of the pedal arm, the force of the restoring spring element acts upon the abutment of the first lever arm of the lever and does not cause the restoring spring element to become bent. By this means, a transmission of force from the restoring spring element to the abutment of the first lever arm of the lever is ensured in a particularly reliable manner during deflection of the pedal arm.

The restoring spring element is advantageously designed as a double leg spring. The restoring spring element thereby has particularly small dimensions and can therefore be arranged in a particularly space-saving manner in the guide provided for the restoring spring element. In this arrangement, the second leg spring ensures normal operation of the pedal even if the first leg spring breaks. Each of the two leg springs is therefore configured in such a manner that even the sole force of one spring ensures the functioning of the pedal.

The restoring spring element is advantageously designed as a biferally wound torsion spring. A biferally wound torsion spring can be fitted in a particularly simple manner into the guide for the restoring spring element, since only one end of the torsion spring and not two ends, as in the case of a double leg spring, have to be arranged or fastened in the guide. By this means, the installation of the restoring spring element in the guide requires a particularly low outlay.

The advantages achieved by the invention comprise, in particular, the fact that a friction element which is to be mounted in or on the second end region of the pedal arm by means of an adhesive material can be fitted in a particularly simple manner and at the same time is connected particularly firmly to the second end region of the pedal arm. During operation of the pedal, the adhesive material particularly reliably prevents the friction surface, which is arranged on the friction element, from vibrating both by itself and also against the second end region of the pedal arm, as a result of which production of noise caused by the friction element is particularly reliably avoided. In addition, it is possible, by means of a friction element which can be mounted separately in or on the end region of the second pedal arm, for the coefficient of friction of the friction pairing to be adapted individually, in particular, to the requirements of the pedal to be manufactured in each case, without a changed design of the second end region of the pedal arm being required for this. Moreover, with a second end region of the pedal arm manufactured from plastic, a light-weight construction of the pedal can be combined with a particularly high resistance to wear of the particular friction surface. The friction pairing formed by the friction body and the friction surface produces a force hysteresis which damps the deflection of the pedal arm and therefore prevents the pedal from swinging freely, as a result of which the power of the internal combustion engine can be controlled in a particularly precise manner by means of foot force.

BRIEF DESCRIPTION OF THE DRAWINGS

An exemplary embodiment of the invention is explained in greater detail with reference to the drawings, in which.

Parts which correspond to one another are provided with the same reference numbers in all of the figures.

DETAILED DESCRIPTION OF THE PREFERRED EMBODIMENT

Figure 1:
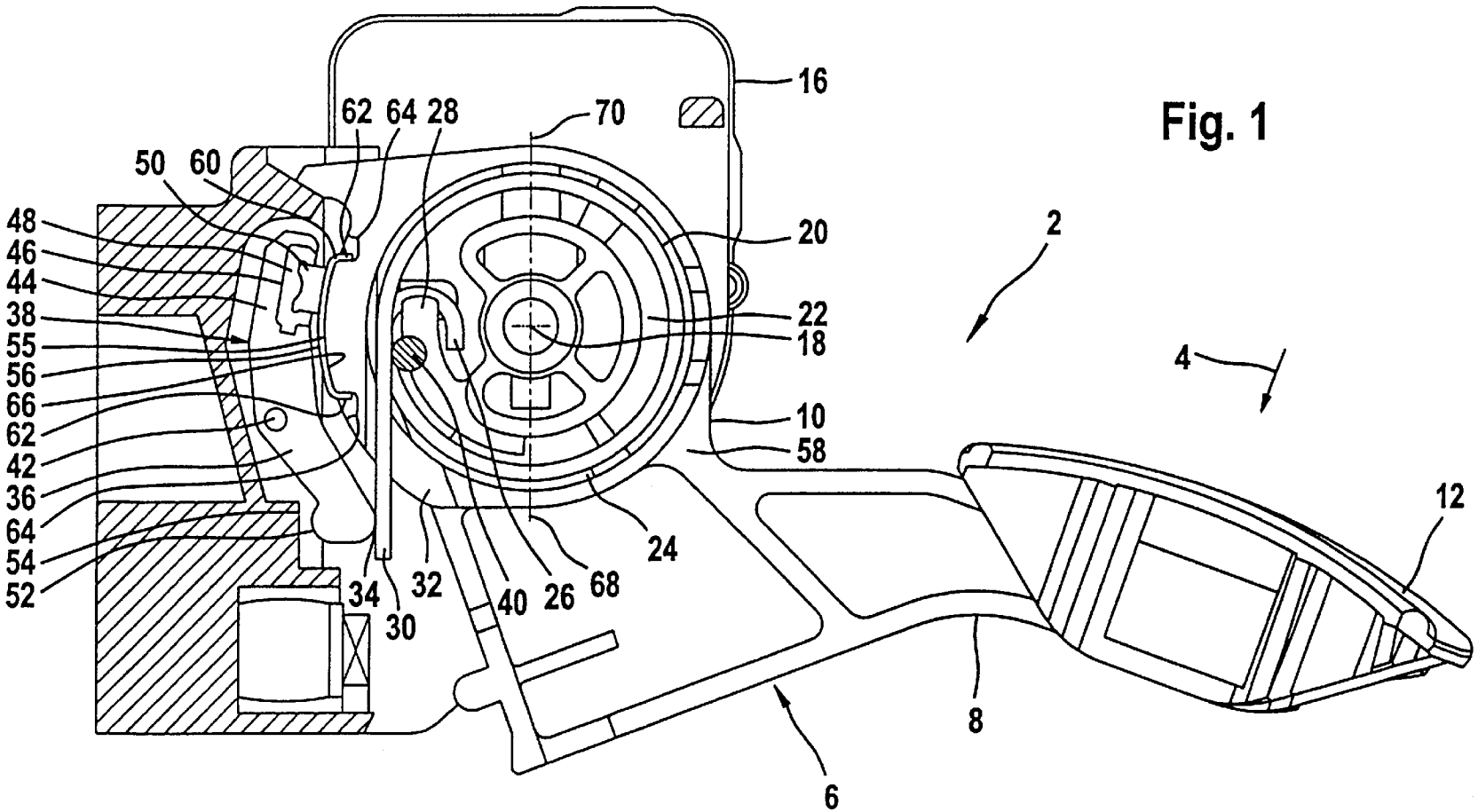
FIG. 1 shows, schematically, a side view of a pedal.

The pedal 2 according to FIG. 1 is designed as a gas pedal of a motor vehicle and can be actuated by foot force 4 of a driver. By actuation of the pedal, the driver controls the speed of the motor vehicle. The driver and the motor vehicle are not illustrated in greater detail in the drawing.

The pedal 2 comprises a pedal arm 6 having a first end region 8 and a second end region 10. The first end region 8 of the pedal 2 has a pedal plate 12 which can be actuated by the foot force 4 of the driver (not detailed) of the motor vehicle (likewise not detailed). The second end region 10 of the pedal arm 6 is mounted in a manner such that it can be pivoted about a pivot spindle 18 mounted in a housing 16. Furthermore, the second end region 10 of the pedal arm 6 is acted upon in a manner such that it can be pivoted back into an initial position by a restoring spring element 20 which surrounds the pivot spindle 18.

The restoring spring element 20 is designed as a double leg spring which is wound biferally. In FIG. 1, only one of the two leg springs can be seen, since according to FIG. 1 the second leg spring is arranged behind the first leg spring and cannot therefore be seen. The restoring spring element 20, which is designed as a double leg spring, is arranged on the second end region 10 of the pedal arm 6 by means of a guide 22. The guide 22 is formed integrally with the second end region 10 of the pedal arm 6. Alternatively, however, the guide may also have one or more elements which can be arranged as a separate guide on the second end region 10 of the pedal arm 6. The guide 22 has an approximately circular groove 24 which is arranged largely concentrically with respect to the pivot spindle 18 and in which the restoring spring element 20, which is designed as a double leg spring, can be guided.

At its inner end 26 which is placed in the guide 22, the restoring spring element 20 is arranged on a holding device 28 assigned to the guide 22. The restoring spring element 20, which is designed as a biferally wound leg spring, is inserted during installation into the guide 22. The inner end 26, at which the first leg spring merges into the second one, is then secured in the guide 22 against springing out by means of the holding device 28. The outer end 30 of the restoring spring element 20, which is designed as a double leg spring, is guided out of the guide 22 via an opening 32. The outer end 30 of the restoring spring element 20, which is designed as a leg spring, can act against an abutment 34 which is arranged on a first lever arm 36 of a lever 38. In order particularly reliably to ensure a direct transmission of force by the restoring spring element 20 to the abutment 34, the outer end 30 of the restoring spring element 20 stops against a supporting device 40. The supporting device 40 particularly reliably prevents the outer end 30 of the restoring spring element 20 from becoming bent in the direction of the guide 20 and therefore prevents a transmission of force of the restoring spring element which is not directed toward the abutment 34.

The lever 38 is mounted in a manner such that it can pivot about an axis 42 and in addition to the first lever arm 36 has a second lever arm 44. The second lever arm 44 has, at its side facing the second end region 10 of the pedal arm 6, a recess 46 into which a vibration damper 48 is inserted. The vibration damper 48 is manufactured from plastic and can be deformed elastically. The plastic is a so called elastomer. A friction body 50 is fastened to the second lever arm 44 of the lever 38 via the friction damper 48. The friction body 50 can vibrate relative to the second lever arm 44 of the lever 38, since it is decoupled mechanically with respect to the lever 38 by virtue of its fastening to the vibration damper 48.

So that the lever 38 is reliably prevented from becoming wedged by the second end region 10 of the pedal arm 6 in all operating states of the pedal 2, the lever 38 has an anti-wear stop 52 on its first lever arm 36, on the side facing away from the second end region 10 of the pedal arm 6. The anti-wear stop 52 can act against a stop 54 which is arranged on the housing 16 of the pivot spindle 18. In this case, the stop 54 is formed integrally with the housing 16 of the pivot spindle 18. Alternatively, however, the stop 54 may also be formed in two pieces with the housing 16 of the pivot spindle 18. The configuration of the anti-wear stop 52 and of the stop 54 is selected in such a manner that the second lever arm 44 of the lever 38 is only able to approach the second end region 10 of the pedal arm 6 as far as a minimum clearance. The restriction on the movement range of the lever 38 particularly reliably avoids the second lever arm 44 from becoming wedged in the second end region 10 of the pedal arm 6 in the event of the friction body 50 becoming detached from the friction damper 48 and/or in the event of the friction damper 48 becoming detached from the recess 46. This enables the pedal 2 to be operated even in the event of the friction body 50 and/or the vibration damper 48 becoming detached from the second lever arm 44 of the lever 38, the functioning of the pedal 2 being greatly restricted, however, since the functioning of the friction body 50 has failed.

The friction body 50 forms a friction pairing with a friction surface 56 arranged on a friction element 55. The friction element 55 which contains the friction surface 56 is arranged on the second end region 10 of the pedal arm 6. In this arrangement, the friction surface 56 of the friction element 55 is curved in a manner so that its curvature points toward the friction body 50. So that a particularly large range of values for the coefficient of friction of the friction pairing can be set, the friction surface 56 and the second end region 10 of the pedal arm 6 are formed in two pieces. In this case, the second end region 10 of the pedal arm 6 is manufactured from a first material 58, which is formed as plastic, in order to obtain a particularly low weight for the pedal 2. The friction element 55 which contains the friction surface 56 is manufactured from a second material 60, which is formed as special steel. In this embodiment, a light-weight construction of the second end region 10 of the pedal arm 6 can be combined with a particularly high resistance to wear of the friction surface 56. Alternatively, the second end region 10 of the pedal arm 6 and the friction element 55 which contains the friction surface 56 can also be manufactured from aluminum. So that the friction surface 56 has a particularly hard surface, the friction surface 56, i.e. the surface of the friction element 55, is anodized. Alternatively, the entire outer surface of the friction element 55 may also be anodized. By this means, the friction surface 56 or the entire outer surface of the friction element 55 is comparatively harder than the surface of the second end region 10 of the pedal arm 6.

For the purpose of the form-fitting connection of the friction element 55 to the second end region 10 of the pedal arm 6, the friction element 55 has a captive securing means 62. The captive securing means 62 grips into corresponding cutouts 64 in the second end region 10 of the pedal arm 6. The cutouts 64 are designed in such a manner that the captive securing means 62 grips in a form-fitting manner into them if the friction element 55 is inserted into the second end region 10 of the pedal arm 6. This form-fitting connection of the friction element 55 to the second end region 10 of the pedal arm 6 enables the installation of the friction element 55 on the second end region 10 of the pedal arm 6 to be particularly simple, since the region provided for the friction element 55 on the second end region 10 of the pedal arm 6 is predetermined unambiguously.

In order to obtain a particularly firm connection of the second end region 10 of the pedal arm 6 to the friction element 55, the friction element 55 is arranged on the second end region 10 of the pedal arm 6 by means of an adhesive material 66. In this connection, the adhesive material 66 is designed as a film which bonds on both sides.

Figure 2:
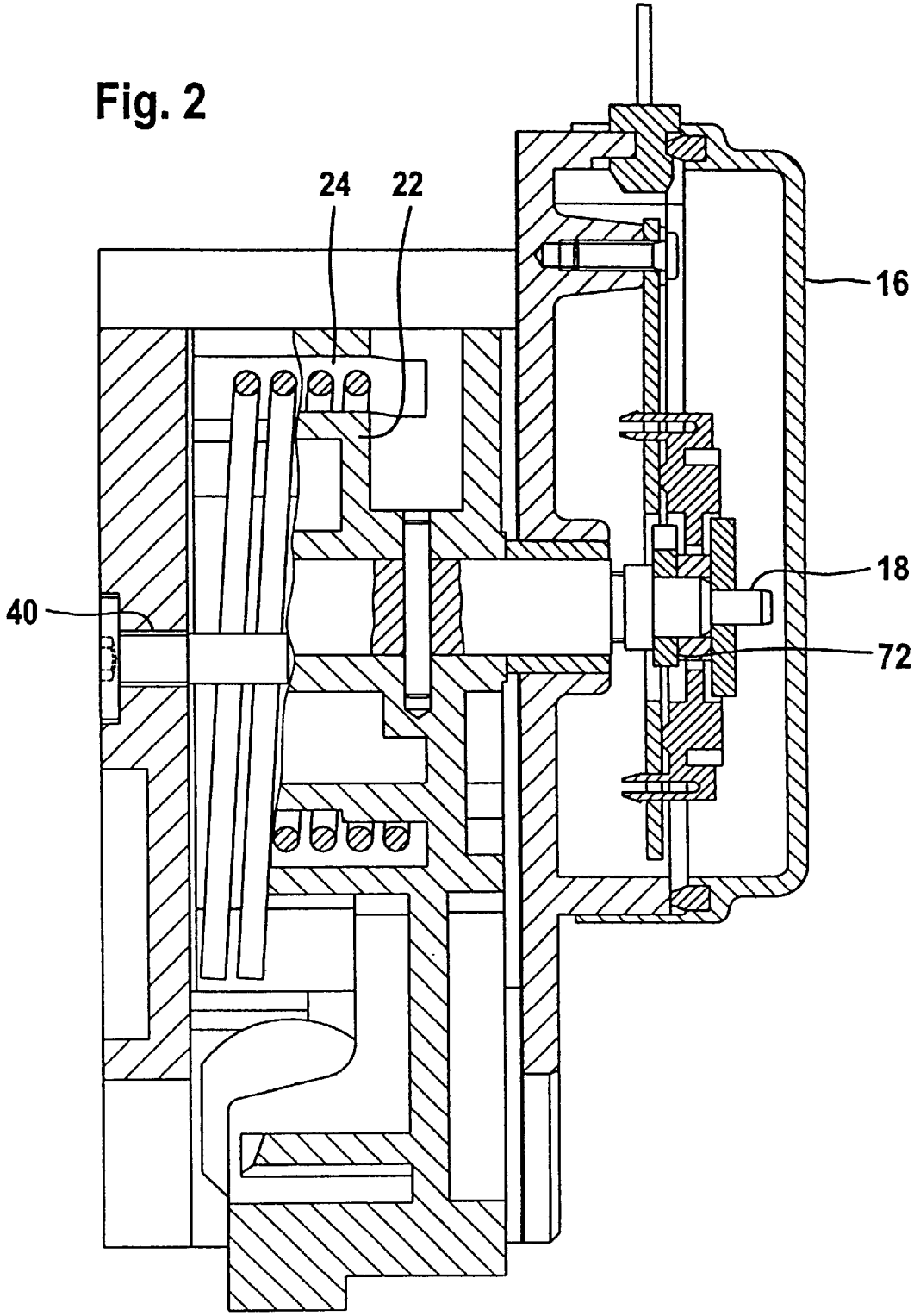
FIG. 2 shows, schematically, a section through the side view of the pedal according to FIG. 1.

FIG. 2 shows a section according to the subsidiary line having the end points 68 and 70 through FIG. 1. The pivot spindle 18 according to FIG. 2 is mounted in the housing 16 by means of a bearing 72. The guide 22 whose groove 24 runs approximately concentrically with respect to the pivot spindle 18 is arranged in the housing 16. The restoring spring element 20, which is designed as a double leg spring, is arranged in the guide 22.

In order to show the arrangement of the supporting device 40, which is designed as a screw, FIG. 2 is also opened up in the region of the supporting device 40. In the additionally opened-up region, the two leg springs of the restoring spring element 20 are visible as bars whereas they are only illustrated in cross section in the remaining regions. It can be seen that the screw which is used as the supporting device 40 is not arranged in alignment with the pivot spindle 18.

Figure 3:
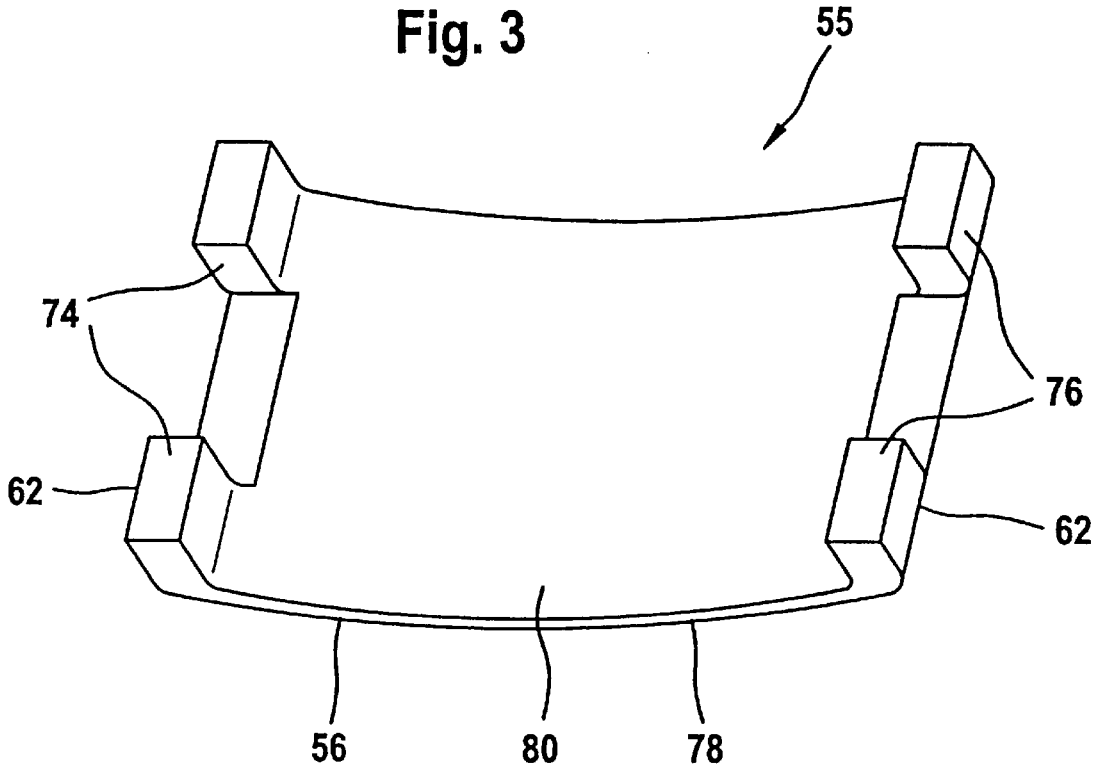
FIG. 3 shows, schematically, a friction element according to FIGS. 1 and 2.

The friction element 55 is illustrated in detail in FIG. 3. The friction element 55 is curved and not flat. As a captive securing means 62, the friction element 55, which is designed as a pressure-exerting piece, has a first pair of webs 74 at its one end and a second pair of webs 76 at its second end. Furthermore, the friction element 55 has a front side 78 and a rear side 80. Before the installation of the friction element 55 on the second end region 10 of the pedal arm 6, the rear side 80 is acted upon by an adhesive material 66 which is designed as a bonding film. Alternatively, the location on the second end region 10 of the pedal arm 6 which is provided for the friction element 55 can also be acted upon by the adhesive material 66 designed as film. The friction element 55 is then fitted into the cutouts 64 in the second end region 10 of the pedal arm 6 with the aid of the captive securing means 62 designed as webs 74 and 76. The front side 78 of the friction element 55 then forms the friction surface 56 in the pedal 2.

During operation of the pedal 2, the driver (not illustrated in the drawing) of the motor vehicle (likewise not illustrated in the drawing) deflects the pedal arm 6 of the pedal 2 in the clockwise direction according to FIG. 1 by means of his foot force 4. In this case, the restoring spring element 20 which is designed as a double leg spring presses against the first lever arm 36 of the lever 38. The friction body 50, which is fastened to the second lever arm 44 of the lever 38 via the vibration damper 48, is thereby pressed against the friction surface 56. This results in a particularly strong friction between the friction body 50 and the friction surface 56 as the pedal arm 6 is increasingly deflected by the foot force 4 of the driver. This frictional force which increases parallel to the deflection of the pedal arm 6 has to be overcome by the driver (not illustrated in the drawing) by means of his foot force 4 as the deflection of the pedal arm 6 increases.

With a rise in the frictional force as the deflection of the pedal arm 6 increases, frictional vibration between the friction body 50 and the friction element 55 can occur. The frictional vibration is an alternate sticking and sliding of the frictional surface 56 along the friction element 50. These vibrations, which are caused by the so-called stick-slip effect, can be perceived by the driver of the motor vehicle as squealing noises. These squealing noises are particularly reliably avoided by the friction body 50, by virtue of the arrangement of the friction body 50 on the vibration damper 48, since said noises are absorbed by the vibration damper 48 which is manufactured from flexible plastic. Vibration of the friction surface 56 is also particularly reliably avoided by virtue of the fixed arrangement of the friction element 55 on the second end region 10 of the pedal arm 6 using the adhesive material 66. This design of a pedal 2 for a motor vehicle therefore particularly reliably suppresses frictional vibration.

In the pedal 2, because of the arrangement of the friction element 55 which contains the friction surface 56 on the second end region 10 of the pedal arm 6 by means of the adhesive material 66, frictional vibration is particularly reliably avoided. In addition, particularly simple installation of the friction element 55 on the second end region 10 of the pedal arm 6 is also ensured. This is because the webs 74 and 76 of the captive securing means 62 assist in the fitting of the friction element 55 on the second end region 10 of the pedal arm 6. The separate formation of the friction element 56 and of the second end region 10 of the pedal arm 6 also makes possible a light-weight construction of the second end region 10 of the pedal arm 6. Resistance to wear of the friction surface 56 by the material of the friction element 55, which is formed as metal, is particularly reliably ensured here. Alternatively or in addition, a surface treatment of the front side 78 of the friction element 56 can ensure the resistance to wear of the friction surface 56. The space-saving construction means that a pedal of this type is particularly suitable for use in motor vehicles as a gas pedal.

We claim:

1. A pedal (2), for a motor vehicle, having a pedal arm (6) which can be deflected at its first end region (8) by a force (4), is mounted at its second end region (10) such that the pedal arm is pivotable about a pivot spindle (18) mounted in a housing (16), and is acted upon such that the pedal arm is pivotable back into an initial position by a restoring spring element (20) which surrounds the pivot spindle (18), the restoring spring element (20) being supported on a first lever arm (36) of a pivotably mounted lever (38) whose second lever arm (44) bears via a friction body (50) against a friction surface (56) which is pivotable about the pivot spindle (18) of the pedal arm (2) and is arranged on the second end region (10) of the pedal arm, wherein the friction surface (56) is part of a friction element (55), and the second end region (10) of the pedal arm (6) is connected fixedly to the friction element (55) via an adhesive material (66).

2. The pedal (2) as claimed in claim 1, wherein the adhesive material (66) is a film which bonds on both sides.

3. The pedal (2) as claimed in claim 1, wherein the friction element (55) which contains the friction surface (56) is arranged in a form-fitting manner on the second end region (10) of the pedal arm (6).

4. The pedal (2) as claimed in claim 1, wherein the surface of the second end region (10) of the pedal arm (6) and the friction surface (56) have different material properties.

5. The pedal (2) as claimed in claim 1, wherein the second end region (10) of the pedal arm (6) is made of a first material (58) and the friction element (55) which contains the friction surface (56) is made of a second material (60) which is different from the first material (58).

6. The pedal (2) as claimed in claim 5, wherein said first material (58) is plastic and the second material (60) is metal.

7. The pedal (2) as claimed in claim 1, wherein the first lever arm (36) of the lever (38) has, on a side facing away from the pedal arm (6), an anti-wear stop (52) which restricts pivoting range of the lever (38) and is actable against a stop (54).

8. The pedal (2) as claimed in claim 1, wherein the second end region (10) of the pedal arm (6) has a guide (22), wherein the restoring spring element (20) is arranged in said guide.

9. The pedal (2) as claimed in claim 1, wherein the restoring spring element (20) is actable at its outer end (32) against an abutment (34) formed on the first lever arm (36) of the lever (38).

10. The pedal (2) as claimed in claim 9, wherein an outer end (30) of the restoring spring element (20) bears against a supporting body (40) determining direction of a spring force of the restoring spring element (20).

11. The pedal (2) as claimed in claim 1, wherein the restoring spring element (20) is a double leg spring.

12. The pedal (2) as claimed in claim 11, wherein the restoring spring element (20) is a biferally wound torsion spring.

* * * * *